United States Patent [19]

Lee

[11] 4,225,293

[45] Sep. 30, 1980

[54] ROTARY ENGINE WITH ARCUATE SEALING VANES

[76] Inventor: Goh H. Lee, 15 Lorong Siglap, Singapore

[21] Appl. No.: 906,208

[22] Filed: May 15, 1978

[30] Foreign Application Priority Data

Nov. 3, 1977 [GB] United Kingdom ..... 21477/77

[51] Int. Cl.[3] ..... F01C 1/00; F01C 19/00; F01C 21/04

[52] U.S. Cl. ..... 418/94; 418/146; 418/237; 418/238

[58] Field of Search ..... 418/94, 146, 236–238, 418/148, 258; 123/210, 243

[56] References Cited

U.S. PATENT DOCUMENTS

| | | | |
|---|---|---|---|
| 778,082 | 12/1904 | Spangler | 123/210 |
| 872,234 | 11/1907 | Henry | 418/237 |
| 1,023,993 | 4/1912 | Charles | 418/146 |
| 1,354,281 | 9/1920 | Carroll | 418/146 |
| 1,839,275 | 1/1932 | Sweningson | 123/210 |
| 2,345,561 | 4/1944 | Allen, Jr. | 418/146 |
| 3,301,232 | 1/1967 | Eickmann | 418/94 |
| 3,387,565 | 6/1968 | Mezzetta | 418/237 |
| 3,749,532 | 7/1973 | Privee et al. | 418/146 |

FOREIGN PATENT DOCUMENTS

| | | | |
|---|---|---|---|
| 149192 | 3/1904 | Fed. Rep. of Germany | 418/146 |
| 152125 | 6/1904 | Fed. Rep. of Germany . | |
| 238515 | 9/1911 | Fed. Rep. of Germany . | |
| 1428215 | 5/1969 | Fed. Rep. of Germany . | |
| 1815354 | 8/1970 | Fed. Rep. of Germany . | |
| 1601803 | 12/1970 | Fed. Rep. of Germany | 418/237 |
| 2145229 | 3/1972 | Fed. Rep. of Germany . | |
| 2331215 | 1/1974 | Fed. Rep. of Germany | 418/237 |
| 593633 | 5/1925 | France . | |
| 774648 | 9/1934 | France . | |
| 89630 | 5/1957 | Norway . | |
| 249478 | 4/1948 | Switzerland . | |
| 93867 | 12/1938 | Sweden . | |
| 381727 | 10/1932 | United Kingdom . | |
| 480872 | 3/1938 | United Kingdom . | |
| 556956 | 10/1943 | United Kingdom . | |
| 923197 | 4/1963 | United Kingdom . | |
| 1078351 | 8/1967 | United Kingdom . | |
| 1177254 | 1/1970 | United Kingdom . | |
| 1221065 | 2/1971 | United Kingdom . | |
| 1242333 | 8/1971 | United Kingdom . | |

*Primary Examiner*—John J. Vrablik

*Attorney, Agent, or Firm*—Larson, Taylor and Hinds

[57] ABSTRACT

In a rotary engine comprising a casing defining an oval working chamber and a rotor mounted in the chamber, the rotor is mounted for simple rotation about the chamber axis and resilient sealing means are provided in the rotor to cooperate with the curved chamber wall to provide suction through an inlet port in the casing, compression and expansion, and exhaustion through an outlet port in the casing during rotation of the rotor.

5 Claims, 6 Drawing Figures

ROTARY ENGINE WITH ARCUATE SEALING VANES

This invention relates to rotary engines.

According to the present invention there is provided a rotary engine comprising a casing defining an oval working chamber and a rotor mounted in the chamber, wherein the rotor is mounted for simple rotation about the chamber axis and resilient sealing means are provided on the rotor to cooperate with the curved chamber wall to provide suction through an inlet port in the casing, compression and expansion, and exhaustion through an outlet port in the casing during rotation of the rotor.

Preferably the sealing means comprise four arcuate sealing members slidably mounted in pairs in two arcuate passages in the rotor, the members of each pair being spring urged apart with contact with the curved chamber wall surface.

Each pair of sealing members may carry an arcuate compression seal on each of the arcuate faces of the sealing members, each compression seal being mounted in recesses in the sealing members and projecting through grooves in the associated end face of the rotor to contact the end chamber wall surface.

Each further acrucate compression seals may be mounted in recesses in each end face of the rotor to form in each rotor said face a compression ring interrupted only by the first mentioned seals.

Each first mentioned compression seal may consist of two arcuate seal parts which are spring urged apart into contact with the curved chamber wall surface.

Each compression seal desirably has a wavy leaf spring under the seal to support it afloat for close contact with the end chamber wall surface for air tight sealing.

Figure 1:
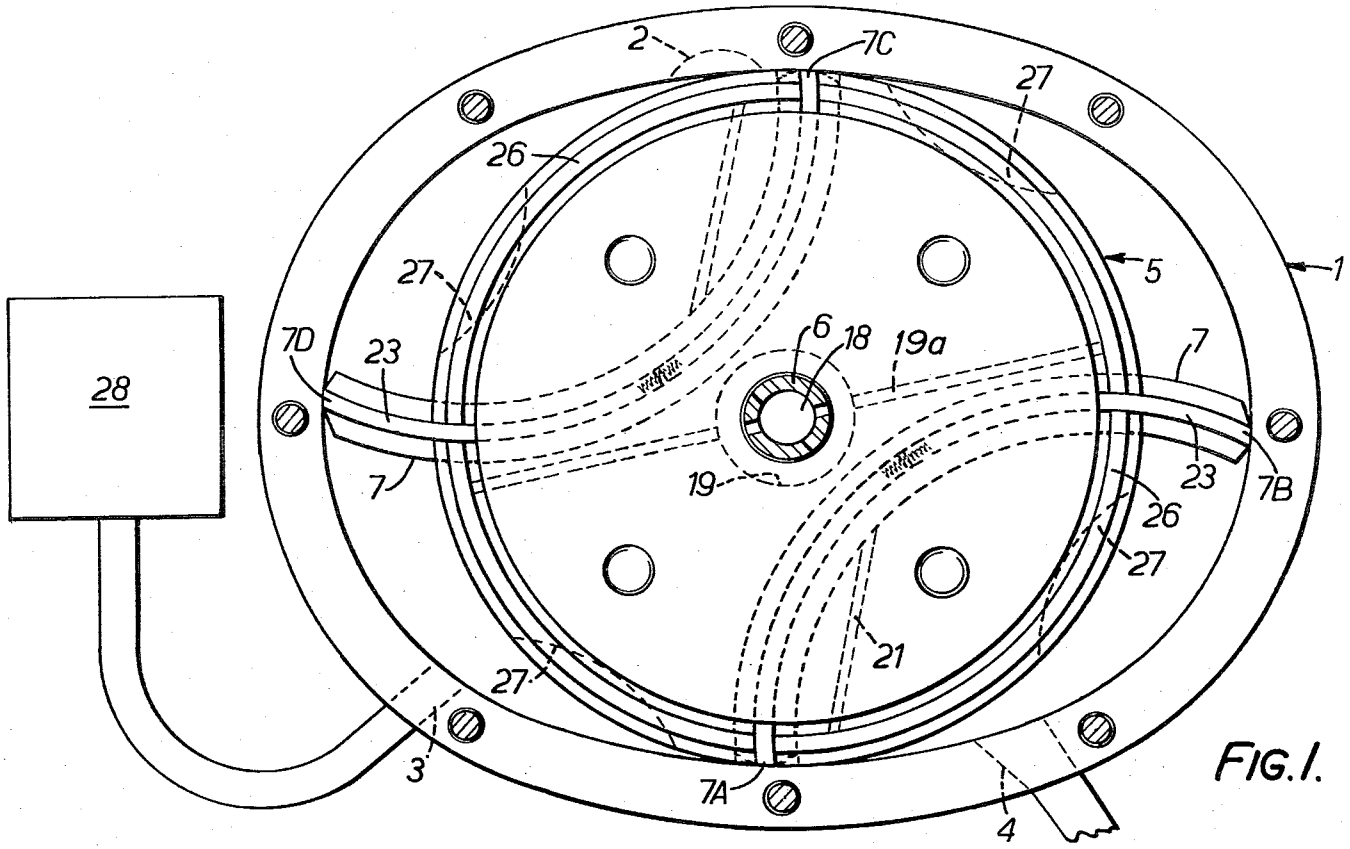
Figures 2, 2A:
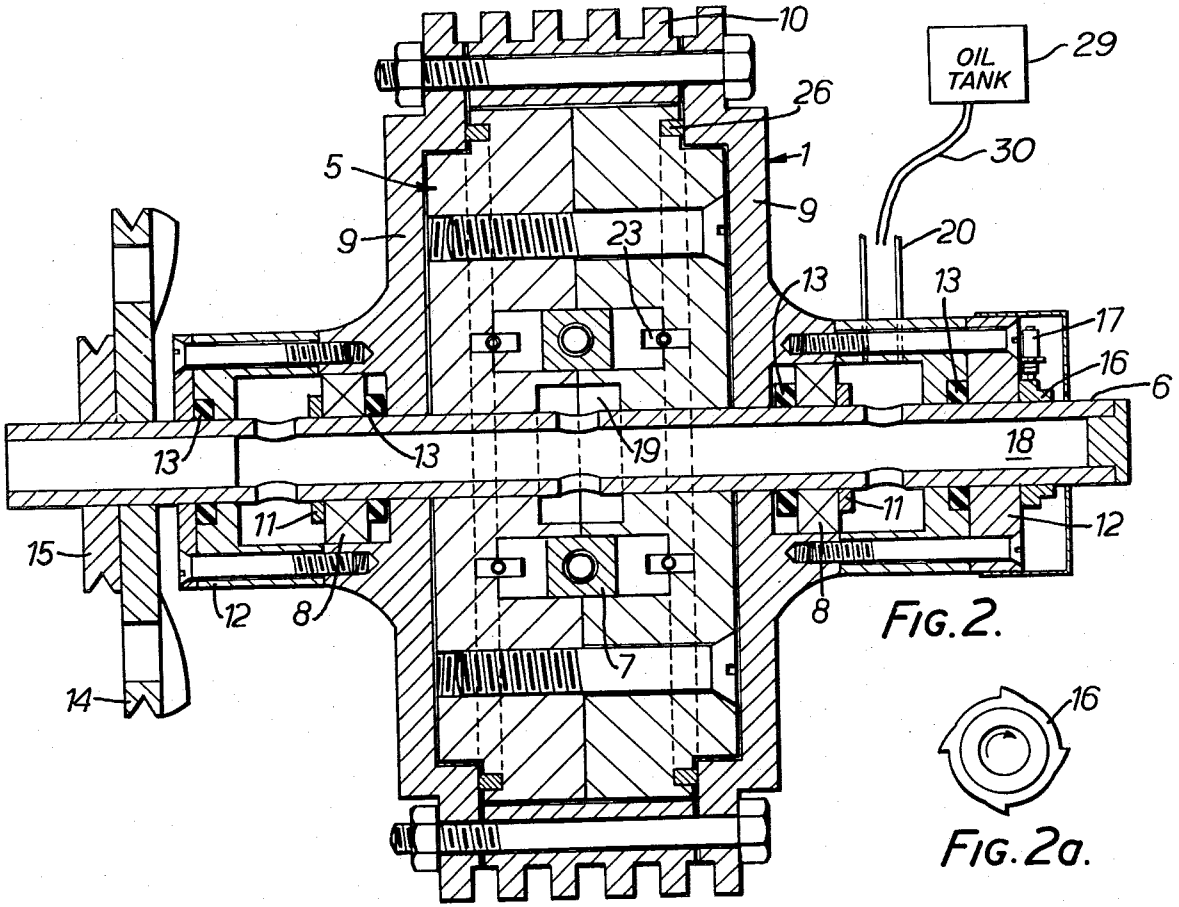
Figure 3:
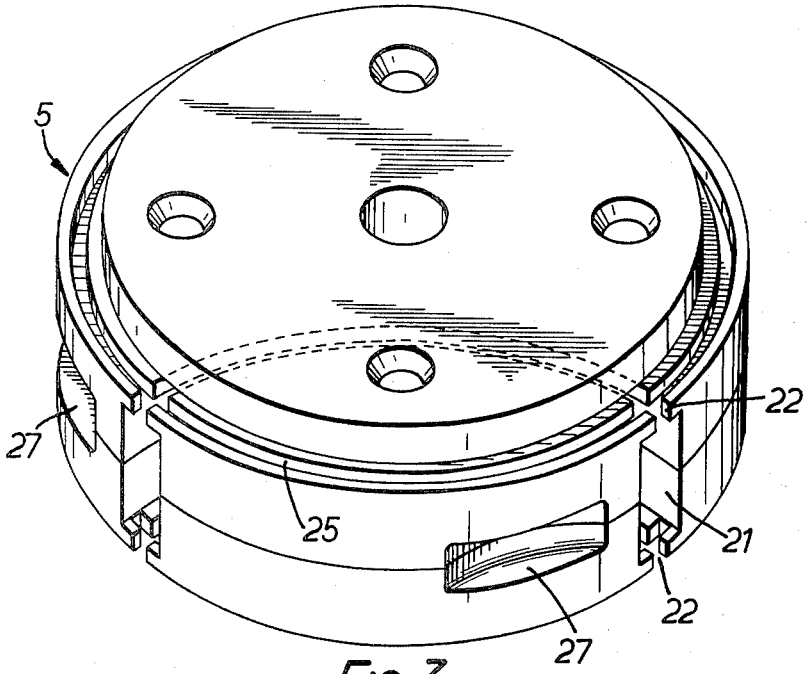
Figure 5:
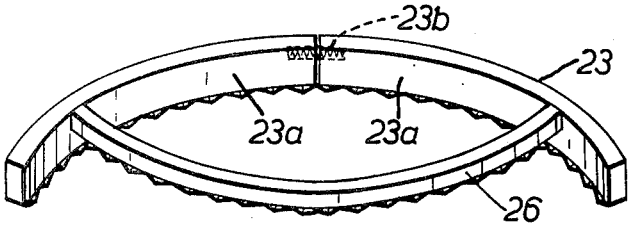
Figure 4:
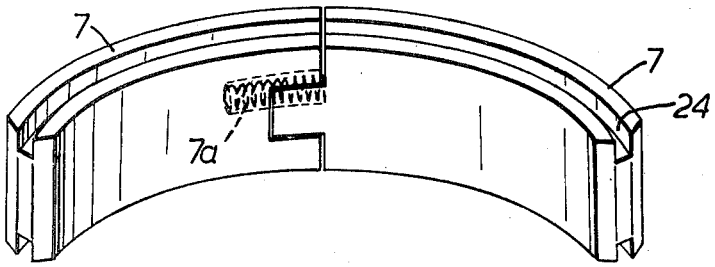

For a better understanding of the invention and to show how the same may be carried into effect, reference is made to the accompanying drawings, in which:

FIG. 1 is a sectional elevation of an engine of the invention showing the casing, rotor, rotor sealing members and compression seals, FIG. 2 is a cross-section of the engine, FIG. 2*a* shows a detail of FIG. 2, FIG. 3 shows a separate, perspective, view of the rotor, FIG. 4 shows a similar view of a pair of sealing members, and FIG. 5 shows a similar view of a pair of compression seals and additional compression seal.

Referring to FIG. 1, the engine has a casing 1 defining an oval working chamber, a combustion chamber 2 with spark plug not shown, an inlet port 3 and an exhaust port 4 and has a rotor 5. The rotor is keyed to a shaft 6 which is supported for simple rotation (i.e. non-eccentric rotation) about the axis of the chamber and is provided with four sliding sealing members 7 A, B, C and D spaced equally about the rotor axis.

As shown in FIG. 2, the rotor shaft 6 is supported in bearings 8 in the engine casing which itself consists of two side plates 9 bolted to a finned barrel 10. The bearings are secured by retaining nuts 11 and are covered with end caps 12, oil seals also being provided at 13. The shaft carries a bladed starter pulley 14 and a combined generator pulley and flywheel 15 at one end and an ignition cam 16 for operating a contact breaker 17 at the other end. The shaft is also provided with a longitudinal passage 18 which establishes a connection between chambers formed by the caps 12 and a central reservoir 19 to form a lubrication system. This is supplied through a filler 20 and also includes oil ways 19*a* leading from the reservoir 19.

Turning now to FIGS. 3, 4 and 5 each pair of sealing members 7 is seated in an arcuate passage 21 in the rotor for sliding motion caused by the curved chamber wall surface when the rotor rotates and the members of each pair are urged apart and into contact with the chamber wall surface by an expansion spring 7*a*. The rotor is made up of two cylindrical parts bolted together to facilitate the forming of the passages 21 and is also formed with upper and lower grooves 22 for arcuate compression seals 23 which themselves seat in recesses 24 in the sealing members 7 and also recesses 25 on the rotor end faces for further arcuate compression seals 26. Both the seals 23 and 26 have wavy leaf springs at their bases to support them afloat for close contact with the end wall surface of the working chamber. Actually each seal 23 is comprised of two parts 23*a* separated by an expansion spring 23*b* to urge the parts into contact with the curved chamber wall surface also. Lastly the rotor incorporates four combustion recesses 27.

In operation of the engine, the rotor 5 carrying the four sealing members 7 A, B, C, D rotates in the clockwise direction as seen in FIG. 1. The sealing member 7 D is moving past the inlet port 3, creates a vacuum and sucks in air-fuel mixture from a carburettor (shown diagrammatically at 28) behind it. Sealing member 7 D carrying a full charge of air-fuel behind it (inlet stroke) is followed by sealing member 7 A which compresses the air-fuel between it and the sealing member 7 D (compression stroke) due to the shape of the working chamber and at the same time sealing member 7 A sucks in a further air-fuel charge behind it. On reaching the combustion chamber 2, the compressed mixture in the combustion recess 27 between sealing members 7 D and 7 A is ignited by the spark plug causing the first combustion/expansion (combustion stroke) forcing the sealing member 7 D with the rotor to spin and to force out the spent gas from the previous combustion between the sealing members 7 D and 7 C through the exhaust port 4 (exhaust stroke).

Whilst sealing members 7 D and 7 A were completing their inlet, compression, combustion and exhaust strokes, the sealing member 7 B following behind was compressing the air-fuel mixture between it and the sealing member 7 A and at the same time, sucking in a further air-fuel charge behind it. On combustion of this charge, the first charge between the sealing member 7 A and 7 D is exhausted through the exhaust port 4. After the first half revolution by the sealing members 7 A and 7 B, the next sealing members 7 C and 7 D will perform the four described strokes likewise and complete the next half revolution. Thus a total of four inlet strokes, four compression strokes, four combustion strokes and four exhaust strokes take place in one revolution of the rotor.

The supply of fuel is from an electric pump via the carburetor 28 provided with an air filter in the usual manner. The ignition is controlled by the four lobed cam 16 on the rotor shaft in cooperation with the contact breaker 17 connected to a coil. This dispenses with a distributor assembly (since this engine has a single plug), timing chains and gears. A high tension wire will connect the spark plug to the coil in the usual manner.

Lubrication is also provided by the above-mentioned lubrication system in which oil is drawn from tank 29, through conduit 30, and, utilizing gravitational force is caused to flow via the oil filler 20 to the two oil chambers at each end of the rotor shaft and to the reservoir 19 where it is stored. When the rotor is spinning, the resulting centrifugal force will throw the oil from the reservoir 19 through the oilways 19*a* to the various points requiring lubrication.

I claim:

1. A rotary internal combustion engine comprising a casing defining an oval working chamber, a rotor mounted in the chamber for simple rotation about the chamber axis and resilient sealing means on the rotor to cooperate with the curved chamber wall to provide suction through an inlet port in the casing, compression and expansion, and exhaustion through an outlet port in the casing during rotation of the rotor, in which the sealing means include first arcuate sealing means mounted in the rotor to contact the curved chamber wall surface and second arcuate sealing means recessed into the first arcuate sealing means and projecting through groove means in each end face of the rotor to contact the chamber end wall surface, the first sealing means including a pair of first arcuate sealing members which are spring urged apart from one another into respective contact with the curved chamber wall surface on opposite sides of the rotor and the second sealing means including a second arcuate sealing member on each arcuate face of each first sealing member with the second arcuate sealing members of each adjacent pair also being spring urged apart from one another into into respective contact with the curved chamber wall surface on-opposite sides of the rotor.

2. A rotary engine as set forth in claim 1, in which each second arcuate sealing member is provided with a wavy leaf spring under the sealing member.

3. A rotary engine as set forth in claim 1, further comprising a lubrication system comprising an oil tank external to the rotor and casing, an oil inlet connected to the tank and leading into an oil cage in the casing which cage surrounds the shaft of the rotor, a longitudinal passage in the shaft which provides a communication between the oil cage and a reservoir in the rotor and oil ways leading from the reservoir.

4. A rotary engine as set forth in claim 1, in which four further arcuate seal parts are mounted in recesses in each end face of the rotor to form on each rotor end face a compression ring interrupted only by the second sealing means.

5. A rotary engine as set forth in claim 4, in which each arcuate seal part is provided with a wavy leaf spring under the seal.

* * * * *